United States Patent [19]

Loomis

[11] Patent Number: 4,638,743

[45] Date of Patent: Jan. 27, 1987

[54] METHOD OF REINFORCING A COVERED HOPPER CAR HATCH

[75] Inventor: Russell M. Loomis, Palos Heights, Ill.

[73] Assignee: Railcar Specialties, Inc., Alsip, Ill.

[21] Appl. No.: 756,291

[22] Filed: Jul. 18, 1985

[51] Int. Cl.[4] ..... B61D 39/00

[52] U.S. Cl. ..... 105/377; 105/396; 52/45

[58] Field of Search ..... 105/247, 248, 377, 396; 52/45-56; 29/402.15, 402.16

[56] References Cited

U.S. PATENT DOCUMENTS

| | | | |
|---|---|---|---|
| 1,068,317 | 7/1913 | Christy | 52/49 |
| 2,537,533 | 1/1951 | Ingalls | 228/119 |
| 3,678,867 | 7/1972 | Brinks et al. | 105/377 |
| 3,797,411 | 3/1974 | Nagy et al. | 105/377 |
| 4,177,736 | 12/1979 | Przybylinski et al. | 105/377 |
| 4,275,662 | 6/1981 | Adler et al. | 105/248 |
| 4,334,481 | 6/1982 | Przbylinski et al. | 105/248 |
| 4,377,058 | 3/1983 | Hallam et al. | 105/377 |
| 4,385,563 | 5/1983 | Bell et al. | 105/377 |

FOREIGN PATENT DOCUMENTS

| | | | |
|---|---|---|---|
| 157582 | 9/1983 | Japan | 228/119 |

*Primary Examiner*—Robert B. Reeves
*Assistant Examiner*—Dennis C. Rodgers
*Attorney, Agent, or Firm*—Leo J. Aubel; Lawrence J. Bassuk

[57] ABSTRACT

A replacement roof sheet for replacing a removed roof section of a covered hopper car roof that has cracks radiating from the square corners of a rectangular hatch. The roof sheet has an arcuate cut-out aligned with the hatch opening and an upstanding, arcuate coaming web joined to said roof sheet at said cut-out, the ends of the coaming web forming joints with exposed ends of the roof coaming peripheral of the hatch opening. Two reinforcing members, having dual-angle standards, bridge the joints to reinforce them. Each member has a base portion secured to the roof sheet and the car roof, a first or lower portion conforming to the inward slope of the roof coaming and secured thereto on one side of the joint, and a second or upper portion conforming to the vertical coaming web and secured thereto on the other side of the joint. An end of the roof sheet overhangs an end wall of the car spaced from the hatch and an end sheet depends to said end wall to cover the space therebetween. The end sheet has a lower margin overlapping the exterior surface of the end wall to accommodate variations in dimensions and installations from car to car. Closure blocks seal gaps between the ends of the roof coaming and coaming web; and closure wedges close gaps between the rounded car roof end wall and the planar roof sheet.

21 Claims, 11 Drawing Figures

METHOD OF REINFORCING A COVERED HOPPER CAR HATCH

BACKGROUND OF THE INVENTION

This invention relates generally to railroad freight cars known as covered hopper cars and more particularly to a method for reinforcing certain areas of the frame of the opening of said hopper cars and a reinforcing kit for said frame.

Covered hopper cars have been constructed and arranged with a roof protecting the contents thereof from weather elements. Access to the interior of the car from above is through a rectangular hatch having a slot-like opening in the roof, the hatch opening extending the length of the car. The hatch is formed by a cowled coaming upstanding from the roof and extending circumferentially or peripherally of the opening. Individual hatch covers are secured lying upon the top margins of the coaming cowl to close the hatch.

A problem has developed in these hopper cars. Cracks in the roof material have occurred radiating from the sharp, rectangular corners of the upstanding coaming at the ends of the hatch. It appears that the cracks are caused by the concentration of stress at the corners of the hatch. The cracks allow water, etc. to leak through the roof to damage the contents of the car.

A prior solution has been the installation of a new roof sheet section providing an arcuate end to the hatch opening. This has removed the portion of the roof sheet having the cracks therethrough and has reduced the recurrence of the cracks by spreading stress across the arc at the end of the hatch opening. One shortcoming of this solution, however, is that the new roof sheet section fails to mate well with the curved junction or seam at the car roof and end wall. This leaves an opening not easily filled with the welding techniques that are desired to be used.

Another shortcoming of this solution concerns the reinforcement of the joints at the roof coaming. The roof coaming slopes inwardly of the hatch opening while a coaming web used with the new roof sheet is vertical or normal to the roof sheet. Thus the ends of the roof coaming, and the coaming web do not mate squarely but are angled relative to one another, leaving only a short, substantially vertical distance over which they can be joined by welding. The prior solution reinforced each joint with a single tongue of sheet metal that extended from the coaming web and that was secured, by such as rivets, to the end of the roof coaming. This tongue was twisted at the joint to conform to the different angularity of the coamings. The required twist dictates a thin reinforcing tongue while a thick reinforcing member is desired.

A desired replacement roof section should avoid these two shortcomings, be compatible with the inwardly slanting coamings of existing hopper car roofs, and provide suitable tolerance allowances for variations from car to car. Further a modification or "mod" kit should supply all the components necessary to repair the portion of the hopper car roof containing the cracks.

SUMMARY OF THE INVENTION

In accordance with the invention, a covered hopper car having a rectangular hatch through the roof is modified to remove the squared hatch corners and form an arc at the end of the hatch opening. This removes the roof section or sections containing cracks therein and reduces the possibility of recurrence of cracking by spreading roof stress around the arc of the hatch opening.

The invention provides the modification with a planar roof sheet replacing the roof section removed from the car, and a coaming web upstanding normal from the roof sheet to continue the hatch coaming around the arcuate end of the hatch. A pair of reinforcing members bridge the joints between the car coaming ends and the ends of the coaming web, each member having a dual-angle standard portion extending the length of the member to conform with the angularity of each coaming. The member is secured to the roof coaming and to the coaming web on respective sides of the joint to reinforce the joint. A flat end sheet depends from the roof sheet and overlays the outer surface of the car end wall to close the end of the replaced roof section. Closure wedges and closure plugs are welded to margins of the end plate and roof sheet, and roof coaming and coaming web to close gaps otherwise existing therebetween.

The invention further provides a pair of coaming extensions that are each selectively secured along the top margin of the coaming web extending from the joint to form a cowl aligned with the outwardly rolled cowl of the roof coaming. A cover plate, resting on the coaming web around the hatch opening arc and between the coaming extensions adapts the new arcuate hatch opening for closure with the existing, rectangular hatch lids or covers of the hopper car.

Other advantages and features of the invention will become apparent upon making reference to the specification, claims, and drawings to follow.

DESCRIPTION OF THE PREFERRED EMBODIMENT

The invention best will be understood by considering that the invention overcomes deficiencies in a prior solution of a problem of cracks occurring in covered railroad hopper cars. The invention provides structure that solves this cracking problem and that avoids the problems encountered with the prior solution.

Figures 1, 2, 3, 3A, 4:
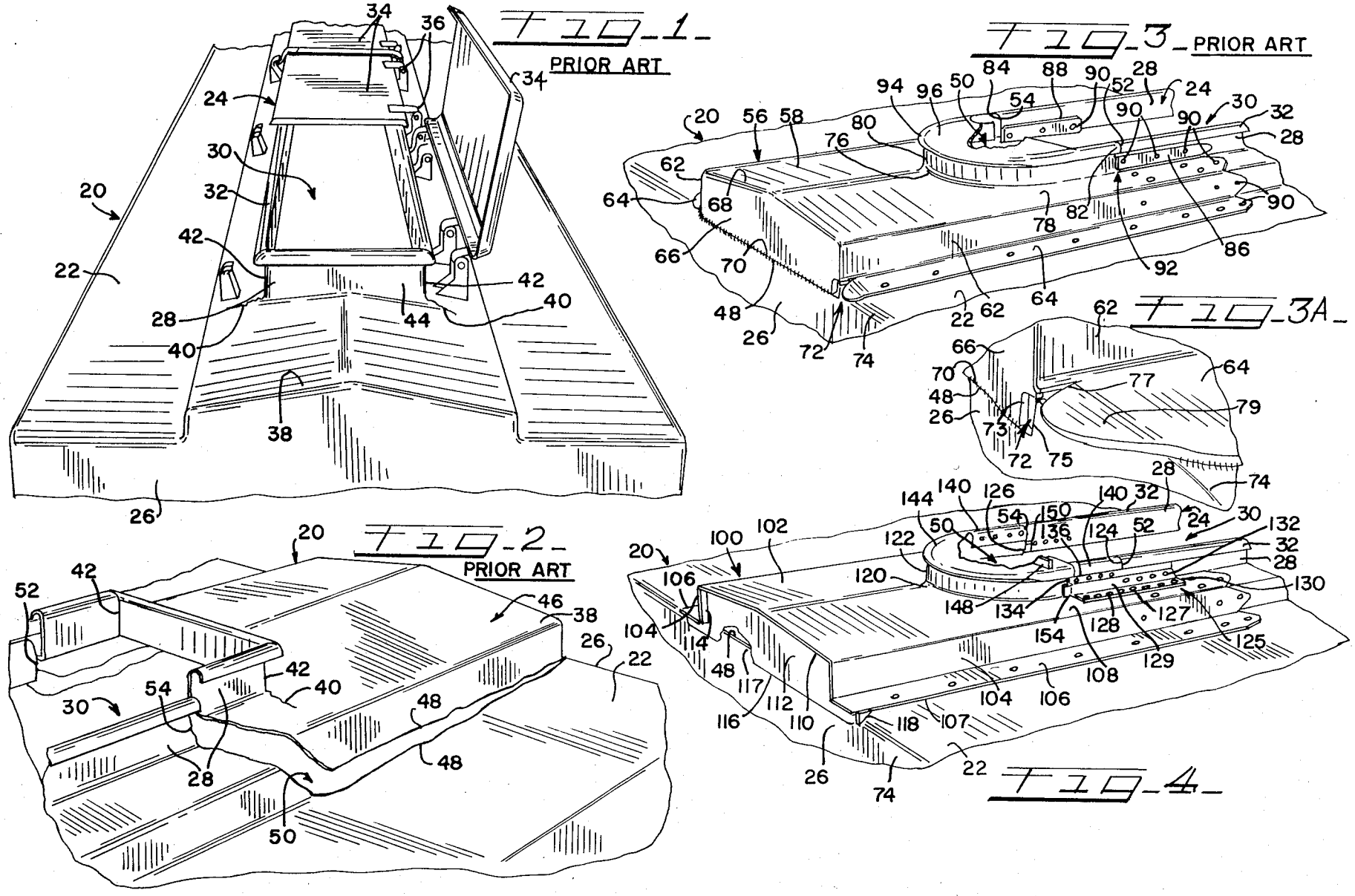
FIG. 1 PRIOR ART
FIG. 2 PRIOR ART
FIG. 3 PRIOR ART
FIG. 1 is a perspective view of the top end of a railroad freight car of the type known as a covered hopper car and having a rectangular hatch in the roof thereof.
FIG. 2 is a perspective view of the covered hopper car from which a section of the roof including the square corners of the hatch is being removed.
FIG. 3 is a perspective view of the covered hopper car with a prior roof sheet assembly replacing the removed roof section.
FIG. 3*a* is a close up view of a portion of FIG. 3.
FIG. 4 is a perspective view of the covered hopper car with a roof sheet assembly of the invention replacing the removed roof section.

In FIG. 1, a railroad freight car known as a covered hopper car is indicated generally by the reference character 20. Hopper car 20 comprises a roof 22 having a rectangular hatch 24 therethrough and an end wall 26. Hatch 24 comprises an upstanding coaming 28 sloping inwardly from the roof over an opening 30. Coaming 28 extends peripherally or circumferentially around opening 30 and terminates at its upper margin in a cowl 32. Cowl 32 forms a lip extending outwardly from the opening 30. Hatch covers 34 include hinges 6 for rotation of covers from a position covering the hatch opening 30 to a position where the hatch opening 30 is uncovered. In the covered position, the hatch covers 34 rest on the cowl 32 of the coaming 28.

Roof 22 includes a raised portion 38 extending from the end 44 of hatch 24 to the end wall 26.

As mentioned above, a problem with the covered hopper cars is the formation of cracks 40 on the raised portion 38 of roof 22, which cracks extend or radiate from the square corners 42 of the hatch 24. It is believed that these cracks 40 result from a concentration of stresses at the corners of the hatch.

As shown in FIG. 2, a prior solution to the crack problem was to remove a section 46 of the roof 22. The removed section substantially comprises the raised section 38 from end wall 26 to beyond the corners 42 of the hatch defined by the coaming 28. Section 46 is removed by such as flame cutting along edges 48 to separate the section 46 from roof 22. Removal of section 46 leaves an aperture 50 in the roof 22 extending from hatch opening 30 to the end wall 26. Removal of section 46 also leaves two exposed ends 52 and 54 of roof coaming 28. The exposed ends 52 and 54 are cut to be substantially vertical. Section 46 then is removed from the car 20.

In FIG. 3, a prior roof sheet assembly 56 is installed on car 20 overlying aperture 50. Prior roof sheet assembly 56 comprises a multi-planar roof sheet 58 substantially located in the position previously occupied by raised portion 38 of roof 22. Roof sheet 58 includes panels 62 and 64 depending from and extending along the lateral margins thereof. An end sheet 66 is flush with and depends from the end 68 of roof sheet 58 and is joined to roof sheet 58 in the space or channel formed by the depending side panels such as 62. The bottom edge 70 of end sheet 66 is in flush abutment with the edge 48 cut in end wall 26 upon removal of section 46 from the car 20. End sheet 66 is joined to roof sheet 58 and end wall 26 by welding.

A shortcoming of this prior roof sheet assembly 56 is the occurrence at installation of misjoinders between parts intended to mate together. Specifically, for example, a gap 72 (see FIG. 3A) often and easily occurs along the edge 48 of the car end wall 26 from which the old roof section 46 was removed and particularly at the corner thereof where a depending edge 73 of the end sheet 66 should mate flush in abutment with an upwardly and inwardly curving edge 75 of the car end wall 26. Variations in the dimensions of the edge 48 cut manually in the field to remove the old, cracked roof section 46 causes this gap 72, and a corresponding gap (not shown) at the opposite corner of edge 48.

Gap 72 extends, additionally, along a cut 77 made in the roof sheet 58 at the bend between vertical side panel 62 and horizontal side panel 64. This cut 77 is necessary for the end tab 79 of the horizontal side panel 64 to be bent downwardly to conform to the smooth, rounded seam 74 between the roof 22 and end wall 26. Cut 77 extends gap 72 from end wall 26, across seam 74 to roof 22. One reason for this gap 72 extending as far as it does is the inability, in this design, of planar end sheet 66 and side panels 62 and 64 to conform to the curved seam 74 of the car 20. Another reason, previously mentioned is the imprecise cutting of the edges 48 when the old roof section 46 is removed. Closing the extented gap 72 can be difficult using field welding techniques, which leave a sloppy appearance and evidence an improper fit between the parts.

A further shortcoming of the prior art, is that the removed roof section 46 has to be precisely dimensioned from the exposed ends 52, 54 of the roof coaming 28 to the end wall 26. Otherwise, the end 68 of roof sheet 58 will not be in vertical registration with end wall 26. This could result in end sheet 66 having to be adjusted, by bending, to fit in the allotted position. This adjustment is undesirable at a field installation site.

Roof sheet 58 includes an arcuate or "U"-shaped cut-out 76 at a section 78 thereof opposite end 68. Cut-out 76 is aligned with hatch opening 30 to terminate or close the hatch opening 30 with an arcuate shape intended to spread stress in the roof 22 and end sheet 58 across the radius of the "U"-shaped cut-out 76. This should reduce the possibility of cracks developing in the roof sheet 58 from roof stress concentrated at the hatch 24.

Prior roof sheet assembly 56 includes a coaming web 80 formed of such as a strip of sheet metal bent into an arcuate or "U"-shape conforming to the shape of cut-out 76. Coaming web 80 is joined to roof sheet 58 by such as welding to be upstanding from roof sheet 58 substantially normal or perpendicular to the plane of roof sheet 58. Coaming web 80 has ends 82 and 84 that abut with ends 52 and 54 of the roof coaming 28. Coaming web 80 includes tongues 86 (only one shown) that extend beyond the joints to be formed at the coaming web and roof coaming ends. The tongues 86 are secured to the roof coaming 28 with a reinforcing plate 88, interior of roof coaming 28, with a plurality of fasteners 90, such as huck rivets, passing through the tongue 86, the roof coaming 28 and the reinforcing plate 88. The ends of the tongue 86, and the ends of roof sheet 58, and panels 62 and 64 also are connected or secured to the roof 22 with such as fasteners 90.

The roof coaming 28 slopes upwardly from roof 22 and inwardly of hatch opening 30 at an obtuse angle relative to the roof 22. The coaming web 80, however, upstands substantially normal or perpendicular to the roof sheet 58 at the periphery of cut-out 76. The ends 82 and 84 of the coaming web 80, thus, are not square with the ends 52 and 54 of the coaming 28 but are angled one relative to the other. The ends 82 and 84 are welded to the ends 52 and 54 in their differently angled positions with the coaming web tongue 86 being twisted at locations 92 (one shown), this position being the joint between the coaming ends, so as to conform to the vertical angle of the coaming web and the inward slope angle of the roof coaming 28. The required twist in the tongue 86 dictates that the coaming web be formed of sheet metal material weak enough readily to be twisted to accommodate the different angle of the roof coaming 28. Gaps between the ends of the coaming web and the roof coaming are filled by welding techniques. Thus, the only reinforcement bridging the joints at the ends of the coamings are the tongues 86.

Coaming web 80 includes a roll cowl 94 intended to mate with the cowl 32 of the roof coaming 28. A table plate 96 rests on the roll or pipe cowl 94 and has a straight edge 98 adapting the new arcuate end of the hatch opening 30 for closure by the rectangular hatch covers 34 that continue to be used with the hatch 24. Table plate 96 is welded to the pipe cowl 94 for sealing the hatch to weather elements.

After this necessary description of the best known prior art, reference is now made to FIG. 4 which shows a roof sheet assembly constructed and arranged in accordance with the invention and indicated generally by the reference character 100. Assembly 100 includes a roof sheet 102 overlying and closing aperture 50 in car roof 22. Roof sheet 102 is a peaked generally dual planar member having a pair of laterally extending side panels 104 and 106 that are bent to conform to the curvature of roof 22. Roof sheet 102 has one end 108 adjacent the hatch opening 30 and a second opposed end 110 overhanging the end wall 26 of car 20.

Figure 5:
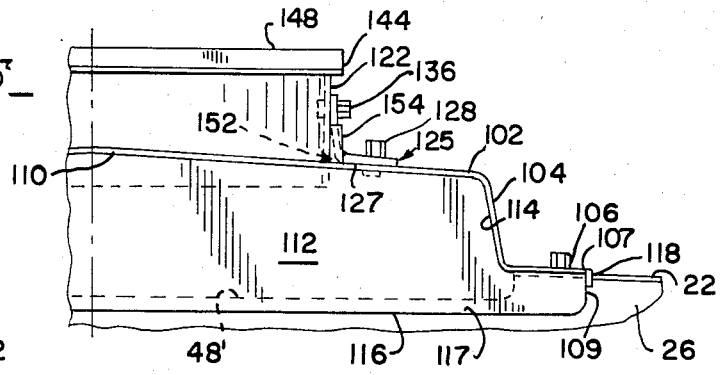
FIG. 5 is sn end view of the right half fragment of the roof sheet assembly installed on the car with an end sheet in elevation.

Referring also to FIG. 5, the assembly 100 includes an end sheet 112 depending substantially perpendicular from the roof sheet 102. End sheet 112 is a generally planar member having a top margin 114 generally conforming to the configuration of the roof sheet 102 overhanging the end wall 26. The bottom margin 116 of end sheet 112 extends downwardly below the edge 48 (see also FIG. 5) of the car at which the roof section 46 was removed and thereby overlaps the exterior surface of end wall 26 along the area 117. End sheet 112 is joined to the roof sheet and end wall 26 by such as welding to close the space between the edge 48 of end wall 26 and the bottom surface of roof sheet 102, leaving a clean appearance.

A pair of closure wedges 118 (only one shown) are fixed in position at the juncture of the planar roof sheet panel 106, the planar end sheet 112 and the rounded juncture 74 of roof 22 and end wall 26. Closure wedges 118 are welded in place to close the gap thereat otherwise existing with the roof sheet assembly installation. Closure wedge 118 readily can be welded against or overlapping the car end wall 26, the car roof 22, and abutting the edge 109 of roof sheet 102 and the edge 109 of end sheet 112 to provide a seal against entry of weather elements to the interior of the car 20. The registration of the edge 107 of roof sheet panel 106 and the edge 109 of end sheet 112 facilitates installation of closure wedge thereto to close the gap at the rounded junction 74. Alternatively, the gap can be sealed by multiple pass welding techniques building up beads of weld material.

The overhang of roof sheet 102 over or beyond the end sheet 112 as shown in the cutout section of FIG. 4 facilitates the joining of these two members by such as welding. Importantly the overhang of end sheet 112 on end wall 26 also provides for tolerance allowances for variations in the relative dimensions and shapes of the roof sheet assembly 100 and the roofs from car to car.

Roof sheet 102 includes an arcuate or "U"-shaped cut-out 120 in its end 108. Cut-out 120 is aligned with hatch opening 30 to terminate hatch opening 30 in a arcuate shape intended to spread any stress induced thereat across the circumference of the cut-out 120.

Assembly 100 includes a coaming web 122 that is bent into an arcuate or "U"-shape conforming to the shape of cut-out 120 and is installed at the periphery of cut-out 120 to be upstanding from roof sheet 102 substantially normal thereto. The coaming web 122 has ends 124 and 126 that abut with ends 52 and 54 of roof coaming 28. Coaming web 122 is substantially vertical while coaming 28 slopes inwardly of hatch 30 and upwardly at an obtuse angle from roof 22. The ends of the coaming web thus are not square with the ends of the roof coaming but are angled relative thereto. This provides only a short distance over which the coaming web ends and the coaming ends can be joined by such as welding.

The roof sheet assembly 100 provides for reinforcing the joints between the ends 124, 126 and 52, 54 with a pair of reinforcement members 125 (one shown). Reinforcement members 125 substantially are strips of metal bent along their lengths in an "L" shape to have a base part 127 and an upright support or standard part 129 (see FIGS. 8, 9, and 10). Referring also to FIGS. 5 through 10 and particularly to FIG. 8, the reinforcing members 125 have lengths extending across the joints between the ends of the roof coaming 28 and coaming web 122. Base 127 overlies the end 108 of roof sheet 102 and the car roof 22, and is secured thereto by fasteners 128 such as huck rivets.

The standard part 129 of member 125 includes two differently angled portions upstanding or extending from the base 127. A first or lower portion 130 of standard part 129 of said member 125 upstands or extends from said base 127 at the same obtuse angle that the roof coaming 28 slopes up from said roof 22. This first portion 130 (see FIG. 10) is secured only to said roof coaming 28 by fasteners 132, which are such as huck rivets. The first portion 130 extends the length of the reinforcing angle across both sides of the joints between the ends of the coaming web and roof coaming but is secured to only the roof coaming 28 on one side of that joint (see FIG. 7).

A second or upper portion 134 of standard part 129 of the reinforcing member 125 upstands or extends from the first portion 130, whereby it is at the same angle that the coaming web 122 upstands from the roof sheet 102, this angle being substantially 90° and vertical. The second portion 134 is secured to the coaming web by fasteners 136 such as huck rivets (see FIG. 9). The securing of the second portion 134 to the coaming web occurs on only one side of the joint between the ends of the coaming web and coaming.

The reinforcing member 125 is formed of metal plate material to provide substantial strength for reinforcing the joint between the roof sheet assembly and the railroad freight car 20. The dual-angles at which portions 130 and 134 of member 125 extend enables the fastening of the member 125 to the coaming web 122 and the roof coaming 28 manually to accommodate the different angularity of the coamings. One reinforcement member 125 is provided at each side of the hatch opening, exterior of the coamings.

Figure 8:
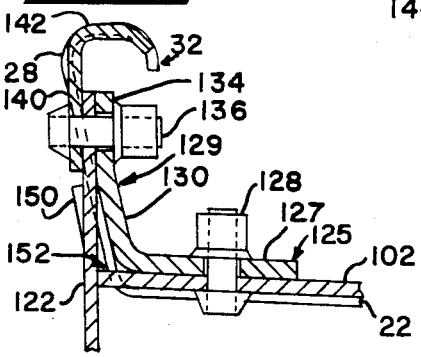
FIG. 8 is a sectional view taken along the line 8—8 of FIG. 7 and in the direction indicated by the arrows.
Figure 9:
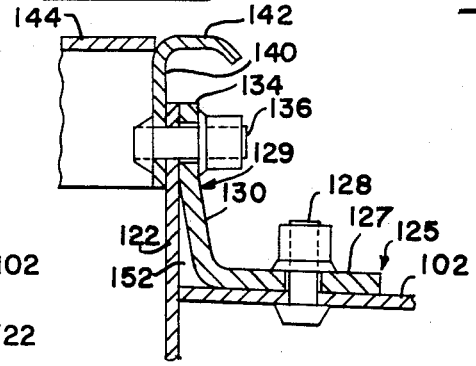
FIG. 9 is a sectional view taken along the line 9—9 of FIG. 7 and in the direction indicated by the arrows.
Figure 10:
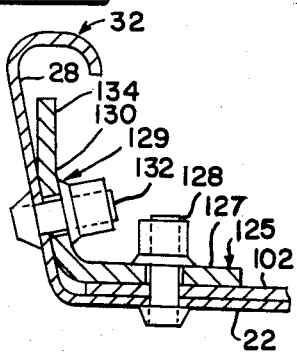
FIG. 10 is a section view taken along the line 10—10 of FIG. 7 and in the direction indicated by the arrows.

In FIG. 8, the standard part 129 of the reinforcement member 125 shows the first or lower portion 130 that conforms to the obtuse angle of the roof coaming 28. The upper or second portion 134 of the standard part 129 is substantially vertical to conform to the vertically extending coaming web.

Returning to FIG. 4 while referring to FIGS. 6, 7, 8 and 9, roof sheet assembly 100 includes a pair of coaming web extensions 140 that serve to extend the coaming cowl 32 over the coaming web 122. Each leg of the coaming web adjacent the joint with the roof coaming carries one coaming extension with the coaming extension upstanding from the coaming web interior of the hatch 30. A portion of the coaming extension 140 overlaps the interior side of the coaming web and the coaming extension is secured to the coaming web by the fasteners 136 also securing the reinforcing member 125 to the coaming web. Coaming extension 140 has a top surface 142, FIGS. 6 through 9, intended to be arranged aligned with the top surface of cowl 32 of roof coaming 28, so that there is a smooth surface along the length of the hatch against which such as gaskets of the hatch covers can seal the hatch opening.

In the preferred embodiment, the coaming extensions 140 are secured by such as welding to the coaming web 122 to form a preassembled sub-assembly also including a cover plate 144. During installation, the top surfaces 142 of the coaming extensions 140 are registered with the top surfaces of cowl 32 and the ends 124 and 126 of the coaming web are welded to tne ends 52 and 54 of the coaming web 28 with the coaming web 122 being welded to the cut-out 120 in roof sheet 102. Raising and lowering coming web 122 in cut-out 120 accomplishes the alignment of the cowls 32 and extension top surfaces 142.

Figure 6:
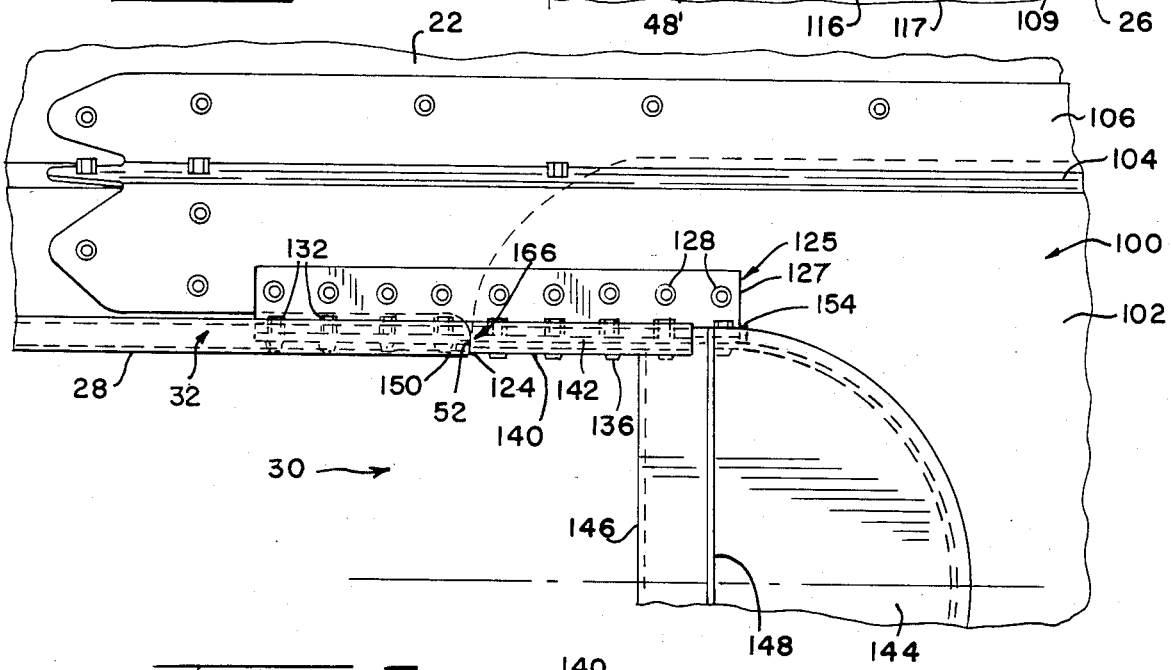
FIG. 6 is a plan view of the right half fragment of the roof sheet assembly installed on the car.
Figure 7:
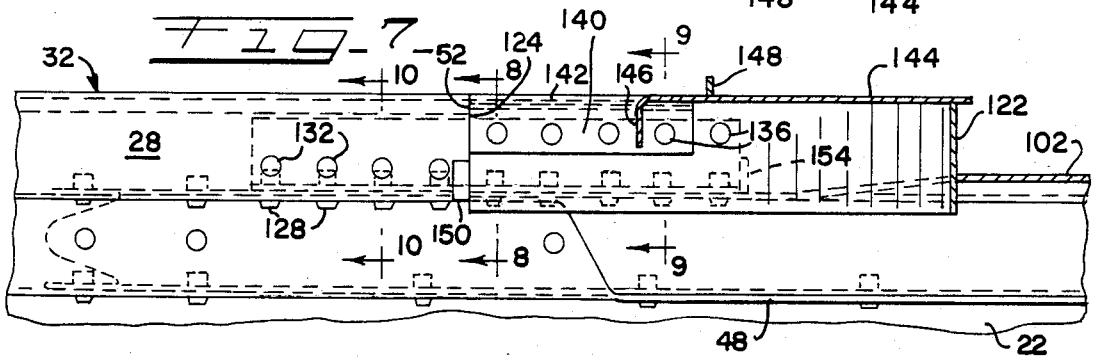
FIG. 7 is an elevation view of the same right half fragment of the roof sheet assembly installed on the car shown in FIG. 6.

As can be appreciated from FIG. 6, the roof sheet assembly 100 adopts the hatch opening 30 now having an arcuate end, to the rectangular hatch covers illustrated in FIG. 1 by providing a cover plate 144 resting on and overhanging the top margin of coaming web 122 and secured thereto by such as welding. Cover plate 144, see also FIG. 7, has a depending lip 146 extending down into the hatch opening 30 between the coaming extensions 140. A closure or weather bar 148 upstands from cover plate 144, spaced from lip 146, to provide protection against elements entering under the closed hatched covers.

Referring to FIGS. 4 through 8, the roof sheet sssembly 100 includes four closure plugs provided to be secured by such as welding to the coaming web to close a gap otherwise there existing between the installed assembly and the car 20. Referring particularly to FIG. 4, a pair of closure plugs 150 (one shown) are secured to the ends 124 and 126 of the coaming web and to the side of roof coaming 28 interior of the hatch opening 30. Referring specifically to FIG. 8, the closure plugs 150 are used to seal a gap 152 otherwise existing between the vertically upstanding coaming web 122, the generally horizontal roof sheet 102 and the obtuse angled coaming 28. Another pair of closure plugs 154 (one shown in FIG. 4) are located at the juncture of the coaming web 122, the roof sheet 102 and the reinforcing member 125 to close the other end of the gap 152. The closure plugs 150 and 154 can be identical structures being generally rectangular solid bodies to be welded in place. Alternatively, plugs 150 and 154 can be eliminated and their function provided by a build up of bead weld material resulting from multiple pass welding techniques.

The roof sheet assembly 100 of the invention thus provides a structurally sound and weather element tight closure for the car 20 while repairing and reinforcing the end of the hatch 24 at which cracks previously occurred.

A kit comprising the structural and closure elements described in connection with the assembly 100 can be installed on a car in any one of several sequences. For example, the components can be received at the installation site in completely disassembled or partially assembled condition. After the section of the roof 46 is removed from the car 20, the new roof sheet 102 is laid in place over the aperture 50 on the roof 22 of car 20 with the cut-out 120 in the roof sheet 102 aligned with the hatch opening 30. This alignment is effected by aligning a corner 166 of the roof sheet, illustrated in FIG. 6 with a dashed line outline, with the end 52 of the coaming 28, this alignment of course occurring on both sides of the cut-out 120. Thereafter the roof sheet can be fastened in place with such as huck rivets. The end sheet 112 can then be assembled to the roof sheet 102 and the end wall 26 with closure wedges 118 being installed. Alternatively, the coaming web 122 and associated components can be installed next.

The coaming web 122 is assembled to the roof sheet 102 at the desired elevation thereabove, with the ends 124 and 126 abutting the ends 52 and 54 of the roof coaming 28. The coaming web 122 then is welded to the roof sheet 102 and to the coaming 28 to secure it in position. Reinforcement members 125 and coaming extensions 140 then are assembled to the coaming web and car and lastly the cover plate 144, closure bar 148 and closure plugs 150, 154 are assembled to the installed components. Alternatively, the coaming web 122 can be preassembled to the roof sheet 102 together with the cover plate and closure bar.

The order in which the parts are assembled to the car may be varied. Passages through the coaming web, roof coaming, roof sheet and car roof for installation of fasteners can be cut in the field at the installation site by using pre-punched holes in the roof sheet, reinforcement member and coaming termination as templates for locating said passageways.

Installation of the roof sheet assembly is readily effected with tools available at such installations sites, such tools being substantially metal working tools such as a cutting and welding torch, drills and riveters. The assembly of the invention avoids close tolerances in any parts to be assembled to existing hopper cars to allow for great variation in dimensions and installation techniques from car to car. The end sheet of the assembly overlaps the end wall 26 of the car allowing substantial variation in the aperture 50 cut in the existing car roof. The reinforcing members having the dual-angle standard portions provide substantial strength to the joints at the existing roof coaming.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. A process of reinforcing a railroad hopper car having a roof and a rectangular hatch opening through the roof, the hatch including a coaming upstanding from the roof peripheral of the opening and sloping inwardly of the opening, and the hatch having an end including two substantially rectangular corners, the process comprising:

A. removing a section of the roof including the end of the hatch having the two substantially rectangular corners by forming in the roof an aperture extending from said hatch opening, said removing including exposing two ends of the roof coaming that slopes inwardly of the opening;

B. covering said aperture with a planar roof sheet, said covering including aligning an arcuate "U"-shaped cut-out in one end of said roof sheet with said hatch opening to form an arcuate "U"-shaped end of said hatch opening, and said covering including abutting and joining together at two joints the two exposed ends of the roof coaming that slopes inwardly of the opening and the two opposed ends of parallel leg portions of a "U"-shaped coaming web upstanding normal from said roof sheet at said arcuate cut-out; and C. bridging each said joint with an elongate reinforcing member, having an elongate base portion, an elongate first portion angled from said base portion and an elongate second portion extending normal to said base portion, by securing said base part of said member to both of said roof and roof sheet, securing to said roof coaming said first portion of said member upstanding from said base at the same angle that the roof coaming slopes from said roof and securing to said coaming web leg portion said second portion of said member upstanding from said base at the same angle that the coaming web stands from said roof sheet.

2. The process of claim, 1 including extending an outwardly directed cowl of the roof coaming by assembling a coaming extension to each of the opposed ends of said coaming web.

3. The process of claim 2 including registering a top surface of each coaming extension to the cowl of the corresponding roof coaming.

4. The process of claim 1 including closing a gap existing between said coaming web, roof sheet and roof coaming by abutting a closure plug to close said gap to interior said car.

5. The process of claim 1 in which said removing includes forming said aperture to an end wall of said hopper car, and including extending an end of said roof sheet to overhang said end wall and closing a space between said end wall and roof sheet by sealing an end sheet to said end wall and roof sheet.

6. The process of claim 5 including overlapping a lower margin of said end sheet on said end wall.

7. The process of claim 5 including closing a gap existing at the juncture of the roof sheet, end sheet, car roof and end wall by installing a closure plug thereat.

8. A hopper car having a roof and a rectangular hatch opening through the roof, the hatch including a coaming upstanding from the roof peripheral of the opening and sloping inwardly of the opening, the hatch having an end with substantially rectangular corners, and a section of the roof and hatch including said corners being removed to expose a pair of ends of said roof coaming sloping inwardly to said opening and to form an aperture extending from said hatch opening, said hopper car comprising:

A. A roof sheet joined to said car covering the aperture, said roof sheet having an arcuate substantially "U"-shaped cut-out in one end thereof aligned with said hatch opening;

B. a coaming web having an arcuate "U" shape matching that of the roof sheet cut-out to present a pair of opposed substantially parallel leg portions, the coaming web being joined to said roof sheet along said cut-out to be upstanding normal to said roof sheet with opposed ends of the parallel leg portions of the coaming web abutting the exposed ends of the inwardly sloping roof coaming to form a pair of joints, the ends of the coaming web and the ends of the roof coaming being angled relative to one another; and C. at least two elongate reinforcing members, each having an elongate base part secured to the roof sheet and the car roof, a first elongate portion upstanding from the base at an angle corresponding to the inward slope of the roof coaming and secured to said coaming adjacent said joint and a second elongate portion extending from said first portion at an angle corresponding to the normal projection of the coaming web from the roof sheet and secured to said coaming web leg portion, said reinforcing members thereby reinforcing said joints.

9. The hopper car of claim 8 including a pair of coaming extensions, each extension being mounted on one of the opposed ends of the coaming web and having a top surface registered with a cowl of the corresponding roof coaming, the coaming extension extending the roof coaming cowl over the coaming web.

10. The hopper car of claim 8 in which there is a gap between each of the ends of the coaming web and the ends of the roof coaming at each joint that otherwise opens to interior said car at said joint due to the angularity between said roof coaming and said coaming web, and including closure blocks installed at said joints abutting the ends of said coaming web and against said roof coaming.

11. The hopper car of claim 10 in which there are closure blocks installed against said coaming web and roof sheet at ends of said reinforcement members spaced from said joints.

12. The hopper car of claim 8 in which said first portion adjacent said base is at an obtuse angle and said second portion is at a vertical angle.

13. The hopper car of claim 8 in which said aperture extends to an end wall of said car, said roof sheet has another end opposite said cut-out end that extends over said end wall to form an open space therebetween, and including an end sheet arranged against said roof sheet and end wall to close said open space, said end sheet having an upper margin conforming to and joined to said roof sheet within said overhang and having a lower margin joined to said end wall.

14. The hopper car of claim 13 in which said end sheet lower margin overlaps said end wall.

15. The hopper car of claim 13 in which there are gaps otherwise opening to interior said car through said aperture at the junctures of said roof sheet and end sheet, and said car roof and end wall, and including closure wedges installed at said gaps abutting said roof sheet and end sheet and overlapping said car roof and end wall to close the gaps.

16. A hopper car hatch reinforcing kit having component parts capable of being assembled to a railroad hopper car for reinforcing the roof of the car at a hatch opening in said roof, the hatch opening being defined by a peripherral coaming upstanding from the roof and sloping inwardly of he opening, and the coaming forming substantially rectangular corners at the end of the hatch, the end of the hatch being spaced from the end wall of the hopper car, the kit comprising:

A. a roof sheet adapted to replace a section of the original hopper car roof from adjacent said end wall to beyond the substantially rectangular corners of the hatch coaming, the roof sheet having a shape generally conforming to the section of the roof to be replaced and having an arcuate "U"-shaped cut-out in one end thereof adapted to be aligned with aid hatch opening;

B. a coaming web having an arcuate "U" shape matching that of the roof sheet cut-out to present a pair of opposed substantially parallel leg portions, the coaming web being adapted to be joined to said roof sheet along said cut-out to be upstanding normal to said roof sheet with opposed ends of the leg portions of the coaming web adapted to abut exposed ends of the inwardly sloping, upstanding roof coaming of the hopper car at joints therebetween with the ends of the coaming web and the ends of the hopper car coaming being angled relative to one another; and C. at least two elongate reinforcing members, each member having an elongate base part adapted to be secured to the roof sheet and the hopper car roof, an elongate first portion upstanding from the base at an angle corresponding to the inward slope of the roof coaming and adapted to be secured to said roof coaming adjacent said joint and an elongate second portion upstanding from the base at an angle corresponding to the normal projection of the coaming web from the roof sheet and adapted to be secured to said leg portion of said coaming web adjacent the joint, each reinforcing member being adapted to be secured to the roof coaming and coaming web across the joints to reinforce the joint.

17. The reinforcing kit of claim 16 including a pair of coaming extensions adapted to be installed on said coaming web opposed ends to extend a cowl of said roof coaming over said coaming web with one coaming extension adapted to being mounted on each opposed end of the coaming web, and each coaming extension having a top surface adapted to be registered with the cowl of the corresponding roof coaming.

18. The reinforcing kit of claim 17 including closure blocks adapted to be installed abutting against said coaming web to close gaps otherwise open to the interior of the car at said joints between said coaming weg and roof coaming.

19. The reinforcing kit of claim 16 including an end sheet adapted to be joined to another end of said roof sheet opposite said cut-out end and adapted to be joined to an end wall of said car to close a space between said roof sheet end wall, said end sheet further being adapted to be joined to said roof sheet under an overhang of said roof sheet extending over said end wall.

20. The reinforcing kit of claim 19 in which said end sheet is adapted to overlap said end wall.

21. The reinforcing kit of claim 19 including closure wedges adapted to be installed abutting said roof sheet and end sheet and overlapping said car roof and end wall to close gaps therebetween otherwise open to interior of said car.

* * * * *